US006710554B2

(12) United States Patent
Amith et al.

(10) Patent No.: US 6,710,554 B2
(45) Date of Patent: Mar. 23, 2004

(54) DIMMER ARRANGEMENT FOR GAS DISCHARGE LAMP WITH INDUCTIVE BALLAST

(75) Inventors: Aviel Amith, Holon (IL); Yefim Berkovich, Holon (IL); Arieh Shenkman, Kfar Saba (IL)

(73) Assignee: Wireless Methods Ltd., Holon (IL)

( * ) Notice: Subject to any disclaimer, the term of this patent is extended or adjusted under 35 U.S.C. 154(b) by 0 days.

(21) Appl. No.: 10/373,037

(22) Filed: Feb. 26, 2003

(65) Prior Publication Data

US 2003/0160579 A1 Aug. 28, 2003

Related U.S. Application Data

(60) Provisional application No. 60/359,721, filed on Feb. 27, 2002.

(51) Int. Cl.[7] ..... G05F 1/00

(52) U.S. Cl. ..... 315/291; 315/307; 363/17

(58) Field of Search ..... 315/151, 158, 315/219, 224, 291, 307, 311, DIG. 4, DIG. 7; 363/98, 16–19, 223, 901

(56) References Cited

U.S. PATENT DOCUMENTS 4,394,603 A * 7/1983 Widmayer ..... 315/311
4,523,131 A * 6/1985 Zansky ..... 315/307
5,430,632 A * 7/1995 Meszlenyi ..... 363/17
6,346,778 B1 * 2/2002 Mason et al. ..... 315/291

* cited by examiner

*Primary Examiner*—Don Wong
*Assistant Examiner*—Jimmy T. Vu
(74) *Attorney, Agent, or Firm*—Mark M. Friedman

(57) ABSTRACT

A dimmer arrangement for a lamp assembly including a gas discharge lamp and an inductive ballast connected to a domestic AC power supply includes a first controllable switch deployed in series with the lamp assembly so as to selectively close a circuit from the power supply through the lamp assembly and a second controllable switch deployed in parallel with the gas discharge lamp assembly so as to selectively close a circuit including the gas discharge lamp and the inductive ballast. A controller cyclically: (a) closes the first controllable switch and opens the second controllable switch, and (b) closes the second controllable switch and opens the first controllable switch. A non-linear saturating inductance connected serially with the first and second controllable switches controls the current during momentary overlap when both switches are closed.

11 Claims, 3 Drawing Sheets

DIMMER ARRANGEMENT FOR GAS DISCHARGE LAMP WITH INDUCTIVE BALLAST

This application is based upon Provisional Patent Application No. 60/359,721 filed Feb. 27, 2002.

FIELD AND BACKGROUND OF THE INVENTION

The present invention relates to arrangements for dimming gas discharge lamps with inductive ballasts.

The predominant trend in gas discharge ("fluorescent") lighting is generally towards the use of electronic ballasts, which provide numerous advantages including the capability of effective dimming of the light. Nevertheless, due to the much higher cost of electronic ballasts for fluorescent lighting, inductive (or "magnetic") ballasts are still widely used.

There is therefore a need for an effective and energy efficient arrangement for dimming a fluorescent light without requiring modification of the lamp or inductive ballast.

SUMMARY OF THE INVENTION

The present invention is an arrangement for dimming gas discharge lamps with inductive ballasts.

According to the teachings of the present invention there is provided, a dimmer arrangement for a gas discharge lamp assembly, the gas discharge lamp assembly including a gas discharge lamp and an inductive ballast, the dimmer arrangement being for connection to a domestic AC power supply, the dimmer arrangement comprising: (a) a first controllable switch deployed in series with the lamp assembly so as to selectively close a circuit from the power supply through the lamp assembly; (b) a second controllable switch deployed in parallel with the gas discharge lamp assembly so as to selectively close a circuit including the gas discharge lamp and the inductive ballast; (c) a controller operatively interconnected with the first and second controllable switches and configured to cyclically: (i) close the first controllable switch and open the second controllable switch, and (ii) close the second controllable switch and open the first controllable switch; and (d) a non-linear saturating inductance connected serially with the first and second controllable switches.

According to a further feature of the present invention, the controller closes and opens the switches at a frequency of at least 1 KHz.

According to a further feature of the present invention, the controller closes and opens the switches at a frequency of no more than 100 KHz.

According to a further feature of the present invention, the controller has an input indicative of a required degree of dimming, the controller being responsive to the input to vary a proportion of each cycle for which the first controllable switch is closed.

According to a further feature of the present invention, the controller is operative to close and open the first and second controllable switches such that a time of overlap during which both the first and second controllable switches are closed lies within a range of 1 nanosecond to 1 microsecond.

According to a further feature of the present invention, the non-linear saturating inductance has a soft magnetic core of cross-sectional area no greater than one square centimeter.

According to a further feature of the present invention, the non-linear saturating inductance includes a coil having no more than 10 turns.

According to a further feature of the present invention, the controller is an analogue controller.

According to a further feature of the present invention, the controller includes a digital processor.

According to a further feature of the present invention, the first and second controllable switches are implemented as transistors.

According to a further feature of the present invention, the first and second controllable switches are implemented as photo-transistors.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a dimming arrangement for discharge lamps with inductive ballast.

The principles and operation of dimming arrangements according to the present invention may be better understood with reference to the drawings and the accompanying description.

Figure 1:
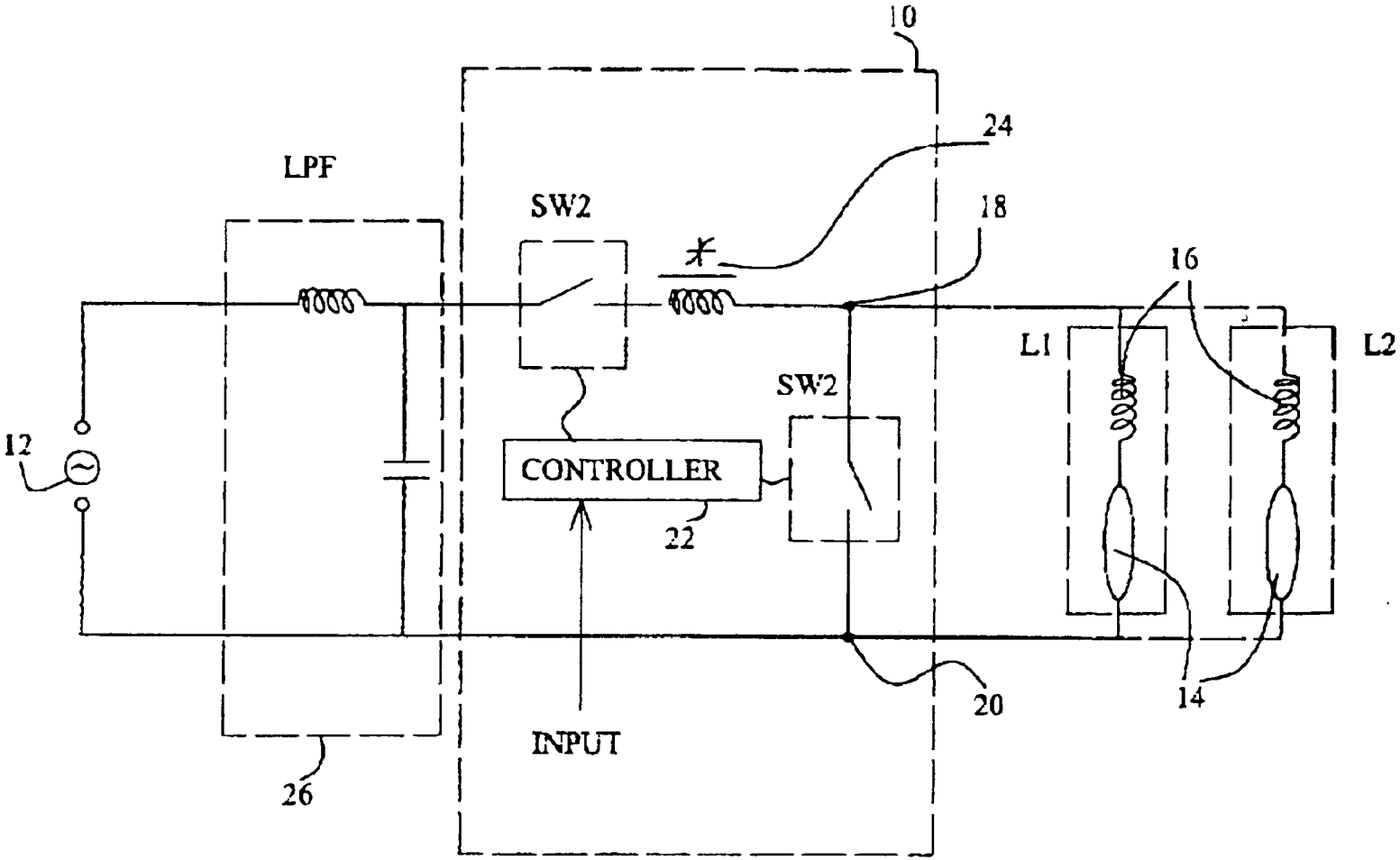
FIG. 1 is a schematic circuit diagram showing a dimming arrangement, constructed and operative according to the teachings of the present invention, for discharge lamps with inductive ballast.
Figure 2:
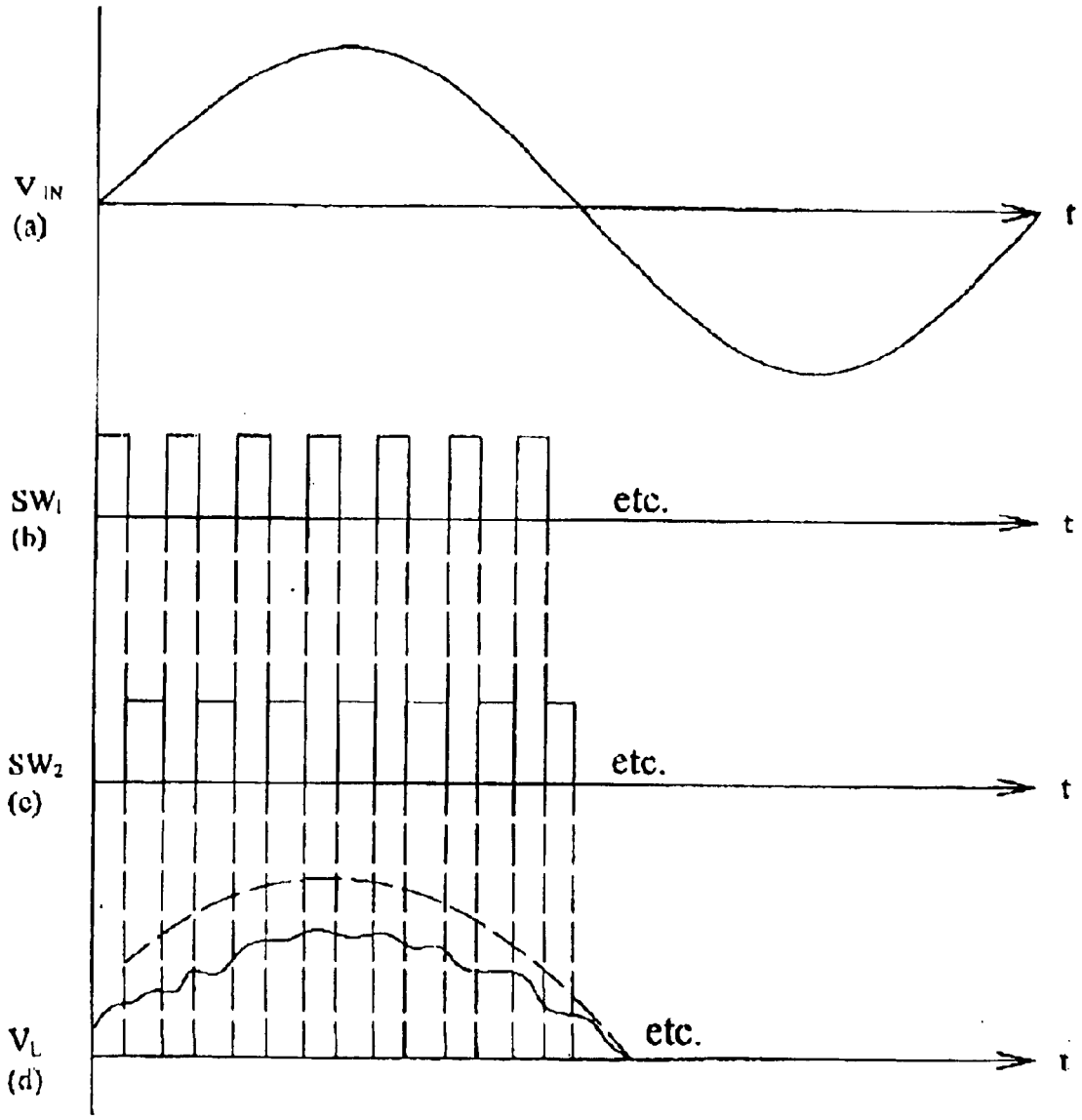
FIG. 2 is a set of plots (a)–(d) illustrating schematically time variation of a supply voltage, an actuating voltage of first and second switches of the circuit of FIG. 1, and a resulting actuation voltage applied across the gas discharge lamp.

Referring now to the drawings, FIGS. 1 and 2 illustrate a first preferred embodiment of a dimming arrangement, generally designated 10, constructed and operative according to the teachings of the present invention, for discharge lamps with inductive ballast.

Generally speaking, dimmer arrangement 10 is interposed between a domestic AC power supply 12 and one or more gas discharge lamp assembly $L_1$, $L_2$ arranged in parallel between output terminals 18 and 20. Each lamp assembly includes a gas discharge lamp 14 and an inductive ballast 16. Dimmer arrangement 10 includes a first controllable switch $SW_1$ deployed in series with the lamp assembly, i.e., between one of the power supply terminals and the corresponding one of terminals 18 and 20, so as to selectively close a circuit from the power supply through the lamp assembly. A second controllable switch $SW_2$ is deployed in parallel with the gas discharge lamp assembly, i.e., between terminals 18 and 20, so as to selectively close a circuit including the gas discharge lamp and the inductive ballast. (Parenthetically, it will be noted that the terms "parallel" and "series" as used herein are defined relative to the power supply. Clearly, in the context of the circuit formed by closing $SW_2$ across the lamp assembly, the switch is actually in series with the lamp assembly.)

A controller 22 is operatively interconnected with controllable switches $SW_1$ and $SW_2$. Controller 22 is configured to cyclically: (1) close switch $SW_1$ and open switch $SW_2$ so that the lamp assembly is in closed circuit with the power supply; and (2) close switch $SW_2$ and open switch $SW_1$ so that the circuit with the power supply is broken and a current induced by decaying fields in the inductive ballast flows through the lamp.

The operation of the dimmer arrangement is represented in FIG. 2 where (a) is the supply voltage, (b) the actuation signal to switch $SW_1$, and (c) the actuation signal to switch $SW_2$. As shown in (d), during the periods that $SW_1$ is closed, the voltage seen by the lamp 14 climbs according to the instantaneous supply voltage as damped by the inductive ballast 16. During the intermediate periods when $SW_2$ is closed and $SW_1$ open, the ballast 16 provides a smoothing effect, continuing to drive the lamp as the magnetic fields in the coil decay. The result is a waveform which approximates to a normal sinusoidal actuation voltage, but has an amplitude which can be controlled by varying the relative widths of the control pulses for the switches, i.e., pulse width modulation ("PWM").

In order to prevent sparking and other effects which would reduce the lifetime of the components, it is important that switch $SW_1$ is not opened without simultaneously closing switch $SW_2$ to allow controlled discharge of the ballast. The switches are therefore switched as near as possible to simultaneously so that in general one, and only one, of the switches is closed at any time.

In practice, it is impossible to achieve absolute precision in the simultaneous switching of the switches. As a result, and in order to avoid leaving an open circuit, there is necessarily some degree of overlap during which one switch has closed and the other has not yet opened. Preferably, controller 22 is operative to close and open the first and second controllable switches such that a time of overlap during which both switches are closed lies within a range of 1 nanosecond to 1 microsecond, and typically in the range of 10–100 nanoseconds. Nevertheless, without special precautions, this simultaneous closing would effectively short across the power supply.

One possible solution to avoid causing momentary shorting of a circuit across the power supply would be to include an additional impedance (e.g., a resistor) in the circuit. This, however, would generally cause large losses and lead to inefficiency of the entire circuit.

To address this problem, it is a particular feature of most preferred implementations of the present invention that dimmer arrangement 10 includes a non-linear saturating inductance 24 connected serially with the first and second controllable switches. A non-linear inductance of this type is sufficient to damp any voltage spikes which would otherwise be caused by the momentary overlap of the two switches being closed. At the same time, the use of a non-linear inductance ensures that inductance 24 rapidly reaches saturation so that it has minimum impact on the overall efficiency of the circuit when switch $SW_2$ is open.

As mentioned earlier, the momentary overlap of the switches during changeover is preferably in the range of 10–100 nanoseconds. For such values, inductance 24 is preferably implemented as a coil with a closed ferrite core of cross-sectional area no more than about 2 $cm^2$, and more preferably no more than about 1 $cm^2$, and with no more than about 10, and typically about 6, turns in the coil. It will be clear to one ordinarily skilled in the art that such a coil results in very small and typically negligible losses in performance of the circuit as a whole.

In order to avoid generating high frequency electronic noise, and in order to minimize energy losses, the output frequency of the controller is preferably less than 100 KHz, and more preferably in the 1–10 KHz range. An output frequency of about 2 KHz is believed to be optimal. To avoid releasing high frequency harmonics back to the power supply network, a low-pass filter ("LPF") 26 is preferably interposed between dimmer arrangement 10 and power supply 12. The operating frequency of controller 22 is preferably not significantly lower than 1 KHz, since selective low-pass filtering on the power supply connections becomes difficult and costly to implement at such low frequencies.

It will be appreciated that the present invention can be implemented using various different types of components. In a first set of prepared implementations, the controllable switches are implemented as electrically controllable switches. One preferred example is FET transistors. Alternatively, optically controllable (e.g., photo-transistors) or any other type of controllable switch can be used.

Similarly, controller 22 may be implemented as an analogue controller or may include a digital processor. In either case, a suitable input is provided to control receive a signal (analogue or digital) indicative of a required degree of dimming. The controller 22 is responsive to the input to vary a proportion of each cycle for which first controllable switch $SW_1$ is closed, thereby controlling the overall dimming effect. The dimming may be either continuous or may vary in a predefined number of discrete steps. The input may be generated by one or more manually operated switch associated with the dimmer arrangement, may be received via a remote control system, or may be otherwise supplied via another device.

Figure 3:
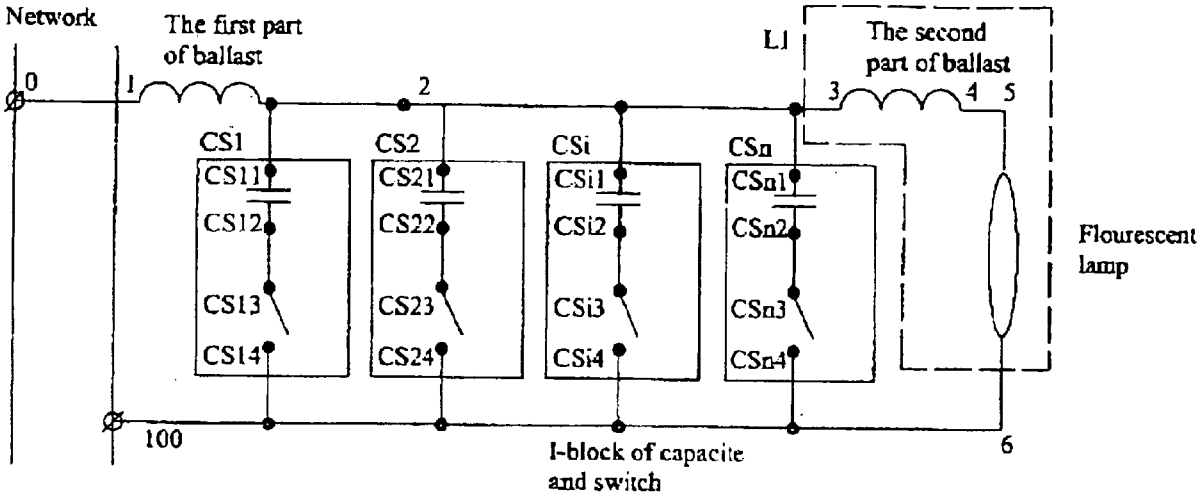
FIG. 3 is a schematic circuit diagram of a first alternative implementation of a dimming arrangement, constructed and operative according to the teachings of the present invention, for discharge lamps with inductive ballast.
Figure 4:
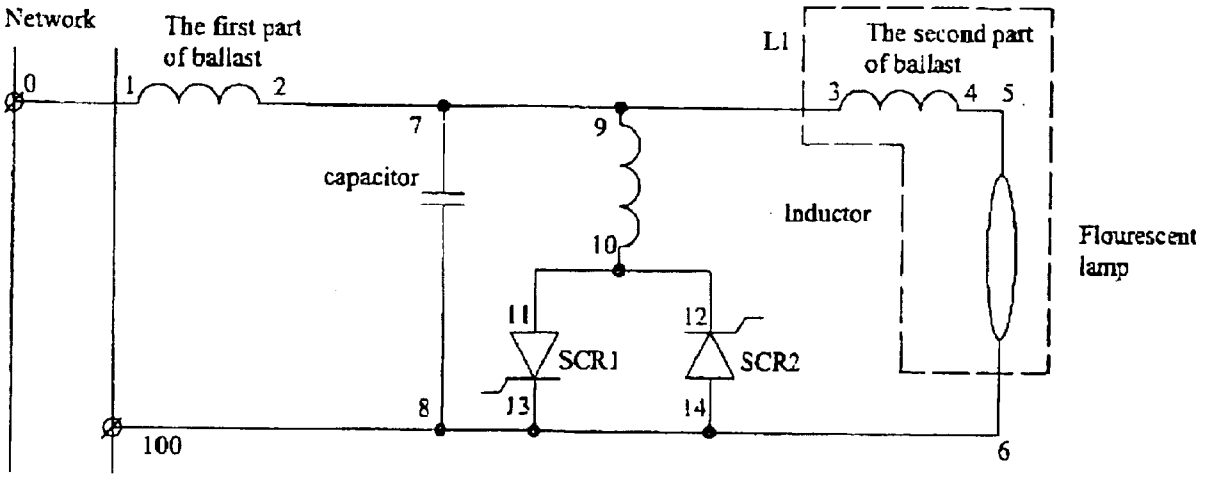
FIG. 4 is a schematic circuit diagram of a second alternative implementation of a dimming arrangement, constructed and operative according to the teachings of the present invention, for discharge lamps with inductive ballast.

Turning now briefly to FIGS. 3 and 4, these show two alternative implementations of a dimmer arrangement for a discharge lamp with inductive ballast, each of which is believed to be patentable in its own right. In both cases, dimming is achieved by adding a dimming inductance in series with the lamp assembly so that a proportion of the voltage is dropped across the dimming inductance. Adjustment (up to full illumination) is then achieved by varying a capacitance connected in parallel with the lamp assembly, thereby varying a degree of resonant compensation for the dimming inductance. When full resonant compensation is achieved, there is effectively no voltage drop across the dimming inductance and full lamp output power is achieved.

In the case of FIG. 3, the adjustable compensation is achieved by selectively closing switches to select one or more of a series of discrete capacitors. In the case of FIG. 4, a fixed capacitor is located in parallel with a "variable inductance" implemented by locating a thyristor pair in series with an inductor. Adjustment of the thyristor thresholds varies the extent of cancellation of the capacitor, and hence the degree of compensation provided for the dimming inductance.

It will be appreciated that the above descriptions are intended only to serve as examples, and that many other embodiments are possible within the spirit and the scope of the present invention.

What is claimed is:

1. A dimmer arrangement for a gas discharge lamp assembly, the gas discharge lamp assembly including a gas discharge lamp and an inductive ballast, the dimmer arrangement being for connection to a domestic AC power supply, the dimmer arrangement comprising:

(a) a first controllable switch deployed in series with said lamp assembly so as to selectively close a circuit from the power supply through said lamp assembly;

(b) a second controllable switch deployed in parallel with said gas discharge lamp assembly so as to selectively close a circuit including said gas discharge lamp and said inductive ballast;

(c) a controller operatively interconnected with said first and second controllable switches and configured to cyclically:

(i) close said first controllable switch and open said second controllable switch, and (ii) close said second controllable switch and open said first controllable switch; and (d) a non-linear saturating inductance connected serially with said first and second controllable switches.

2. The dimmer arrangement of claim 1, wherein said controller closes and opens said switches at a frequency of at least 1 KHz.

3. The dimmer arrangement of claim 1, wherein said controller closes and opens said switches at a frequency of no more than 100 KHz.

4. The dimmer arrangement of claim 1, wherein said controller has an input indicative of a required degree of dimming, said controller being responsive to said input to vary a proportion of each cycle for which said first controllable switch is closed.

5. The dimmer arrangement of claim 1, wherein said controller is operative to close and open said first and second controllable switches such that a time of overlap during which both said first and second controllable switches are closed lies within a range of 1 nanosecond to 1 microsecond.

6. The dimmer arrangement of claim 1, wherein said non-linear saturating inductance has a soft magnetic core of cross-sectional area no greater than one square centimeter.

7. The dimmer arrangement of claim 1, wherein said non-linear saturating inductance includes a coil having no more than 10 turns.

8. The dimmer arrangement of claim 1, wherein said controller is an analogue controller.

9. The dimmer arrangement of claim 1, wherein said controller includes a digital processor.

10. The dimmer arrangement of claim 1, wherein said first and second controllable switches are implemented as transistors.

11. The dimmer arrangement of claim 1, wherein said first and second controllable switches are implemented as phototransistors.

* * * * *